US006348768B1

(12) United States Patent
Weng

(10) Patent No.: US 6,348,768 B1
(45) Date of Patent: Feb. 19, 2002

(54) REMOTE CONTROL DEVICE OF LAMP TUBE

(75) Inventor: Linsong Weng, No. 33, Alley 27, Lane 755, Fu-Hsing Road, Chu-Pei (TW)

(73) Assignees: Hugewin Electronics Co., Ltd.; Linsong Weng, both of Chu-Pai (TW)

( * ) Notice: Subject to any disclaimer, the term of this patent is extended or adjusted under 35 U.S.C. 154(b) by 0 days.

(21) Appl. No.: 09/752,431

(22) Filed: Jan. 3, 2001

(51) Int. Cl.[7] ..... G05F 1/100

(52) U.S. Cl. ..... 315/292; 315/316; 315/307; 315/149; 315/159

(58) Field of Search ..... 315/291, 292, 315/294, 297, 307, 312, 320, 322, 149, 154, 159, 316

(56) References Cited

U.S. PATENT DOCUMENTS 5,489,891 A * 2/1996 Diong et al. ..... 340/567
5,838,116 A * 11/1998 Katyl et al. ..... 315/307
5,990,635 A * 11/1999 Ference et al. ..... 315/362
6,252,358 B1 * 6/2001 Xydis et al. ..... 315/295
6,300,727 B1 * 10/2001 Bryde et al. ..... 315/294

* cited by examiner

*Primary Examiner*—Don Wong
*Assistant Examiner*—Tuyet T. Vo
(74) *Attorney, Agent, or Firm*—Rosenberg, Klein & Lee

(57) ABSTRACT

The present invention proposes a remote control device of lamp tube for controlling the action of at least a lamp tube through wireless remote control way. The remote control device of lamp tube comprises a remote controller module, at least a base, and at least a remote control receiver inserted into the base. The remote controller module is used to emit a remote control signal to be received by the remote control receiver, of which the addressing code has been learned and set beforehand. After unmistakably recognized, the lamp tube will be triggered to generate the on or off action so that the effect of controlling lamp tubes through wireless remote control way can be achieved. The present invention has the characteristics of convenience and flexibility in use.

3 Claims, 4 Drawing Sheets

REMOTE CONTROL DEVICE OF LAMP TUBE

FIELD OF THE INVENTION

The present invention relates to a wireless remote control device and, more particularly, to a remote control device capable of controlling electricity-saving lamp tubes to be turned on or off through wireless remote control way.

BACKGROUND OF THE INVENTION

In prior art, the switches for controlling lamp tubes are usually installed on the wall, and each switch can only control the lamp tubes connected therewith. Except modifying the wiring of the power wires of lamp tubes, it is impossible to change the way of control. However, this engineering must spend much time and money, and thus is very cumbersome.

Along with continual progress of scientific technology, more and more people emphasize the convenience and swiftness of lives. Therefore, wireless remote control means such as televisions, electric fans, audios, and air conditioners have been widely used in everyday lives of modem people. Only lamp tubes for illumination are still controlled through switches fixed on the wall, resulting in much inconvenience. This situation is especially serious for handicapped people, increasing much trouble and inconvenience in their lives.

The present invention aims to let people be capable of flexibly controlling each lamp tube. Moreover, the present invention aims to let handicapped people be capable of controlling the action of each lamp tube through wireless remote control way without the need of other's help. Speaking briefly, the present invention provides a wireless remote control device t o control lamp tubes to be turned on or off.

SUMMARY AND OBJECTS OF THE PRESENT INVENTION

The primary object of the present invention is to provide a wireless remote control device capable of controlling lamp tubes to be turned on or off through wireless remote control way. The wireless remote control device of the present invention can be installed according to necessity, resulting in much convenience and flexibility in use.

Another object of the present invention is to provide a wireless remote control device for controlling lamp tubes so that lamp tubes can be remotely controlled, and a plurality of lamp tubes can be controlled to act simultaneously. Thereby, the on or off states of lamp tubes can be zoned or grouped to achieve convenience and flexibility in management.

According to the present invention, a remote control device of lamp tube comprises a remote controller module for emitting a remote control signal to be received by a remote control receiver installed in a base. The lamp tube is then driven after the signal is unmistakably recognized. Thereby, the device can control the on or off states of at least one lamp tube through wireless remote control way.

The various objects and advantages of the present invention will be more readily understood from the following detailed description when read in conjunction with the appended drawings, in which:

DETAILED DESCRIPTION OF PREFERRED EMBODIMENT

According to the present invention, a remote control device of lamp tube comprises a wireless remote controller module for emitting a remote control signal to be received by a remote control receiver installed in a base. The lamp tube is then driven after the signal is unmistakably recognized. Thereby, the user can control the on or off states of at least one lamp tube through wireless remote control way.

Figure 1:
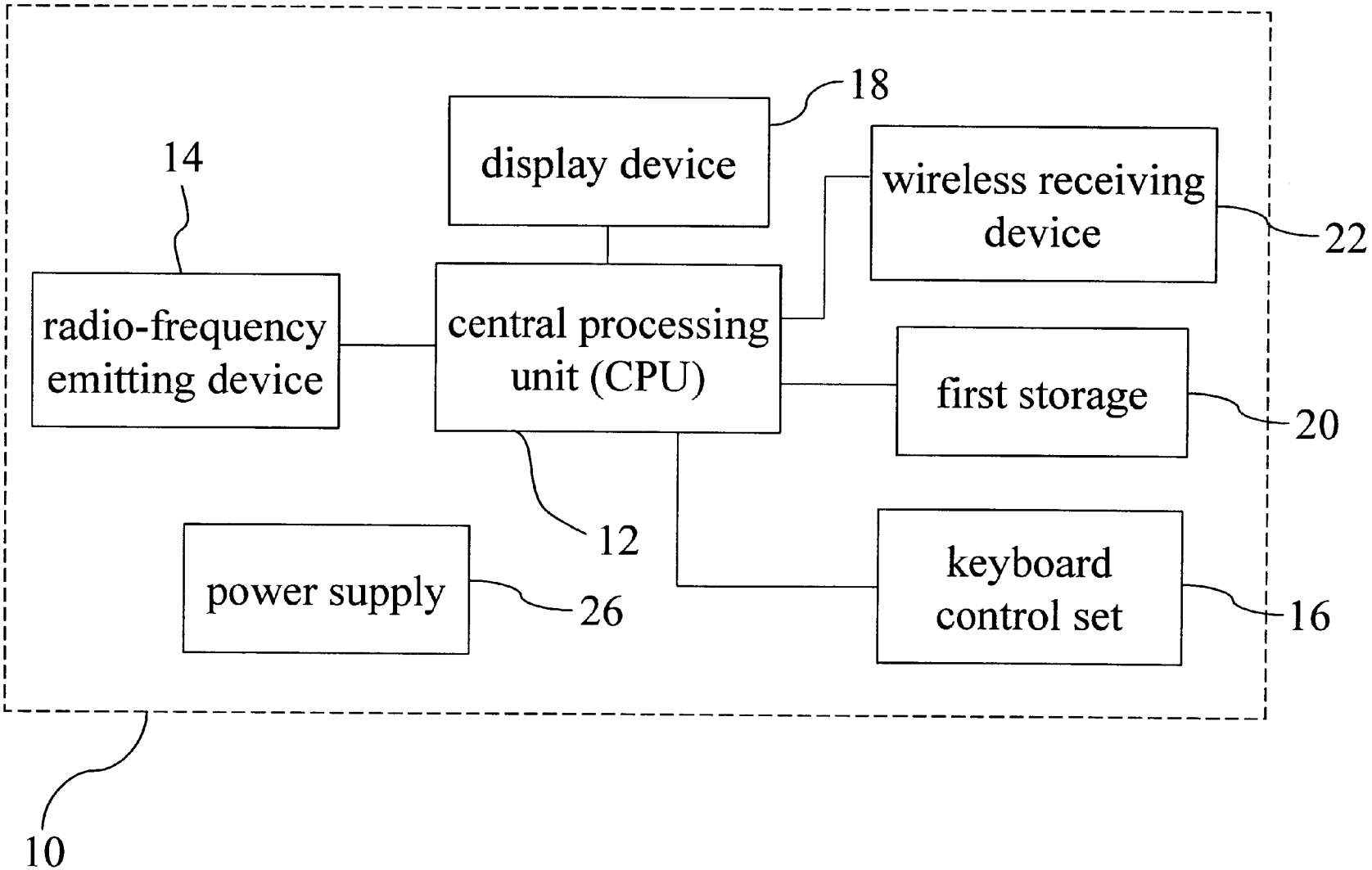
FIG. 1 is a block diagram of the remote controller module of the present invention.

As shown in FIG. 1, a remote controller module 10 comprises a central processing unit (CPU) 12, a radio-frequency (RF) emitting device 14, a keyboard control set 16, a display device 18, a first storage 20, a wireless receiving device 22, and a power supply 26. The CPU is respectively connected to the RF emitting device 14, the keyboard control set 16, the display device 18, the first storage 20, and the wireless receiving device 22. The CPU 12 is used to receive keyed-in data from the keyboard control set 16 and the remote control serial codes and zone codes of the lamp tubes the user wants to control so that the remote control receiver can receive them for learning and recognizing. The remote controller module 10 also displays the codes on the display device 18 and stores them in the first storage 20. The CPU 12 transfers a remote control code to the RF emitting device 14, which will then emit a remote control signal to set and control the remote control receiver. The wireless receiving device 22 connected to the CPU 12 is used to receive and copy data transferred from another remote controller module. The power supply 26, generally being a battery set, is used to provide electricity for each of the above components.

Figure 2:
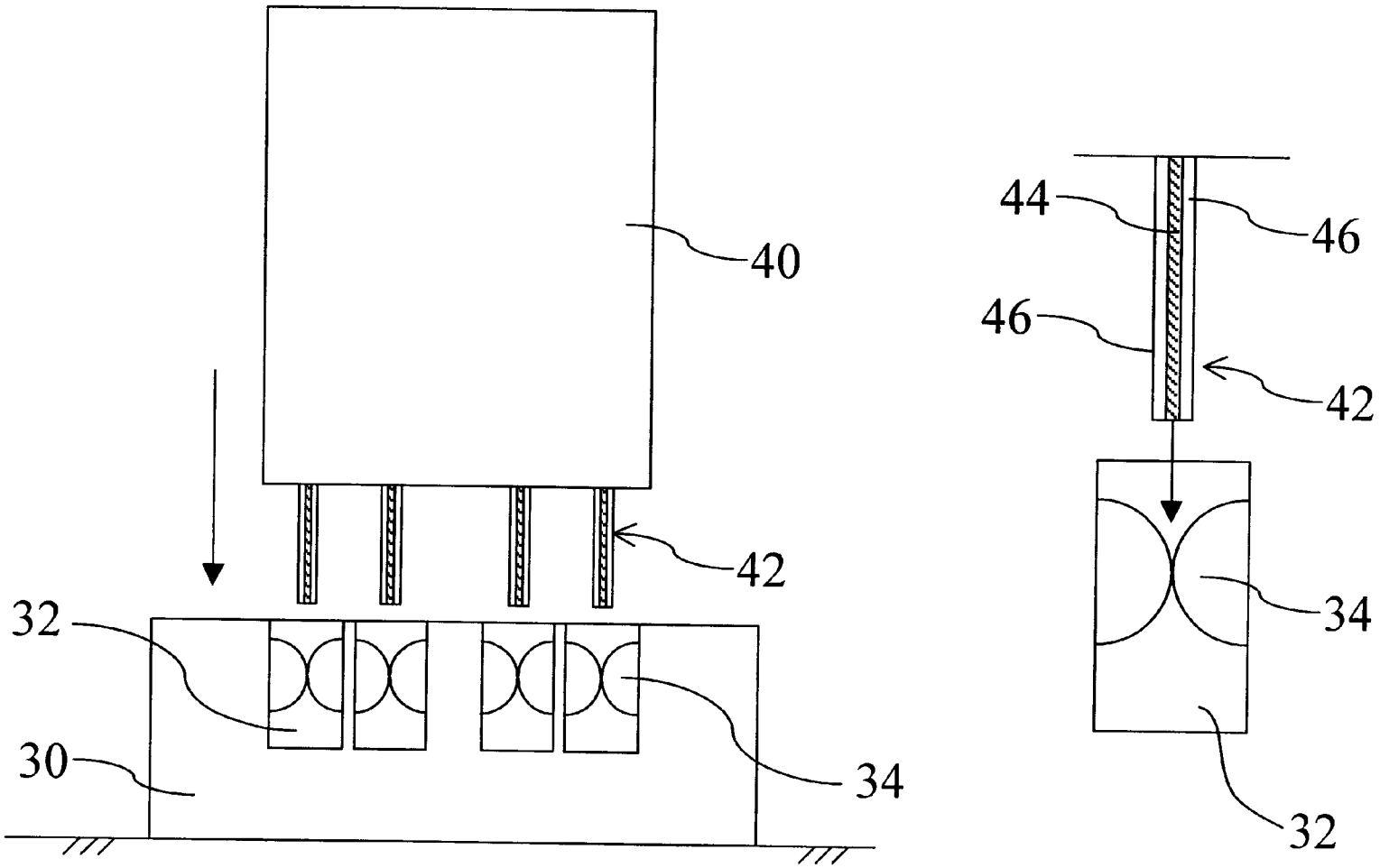
FIG. 2 is a schematic view of the base and the remote control receiver of the present invention before assembled.
Figure 3:
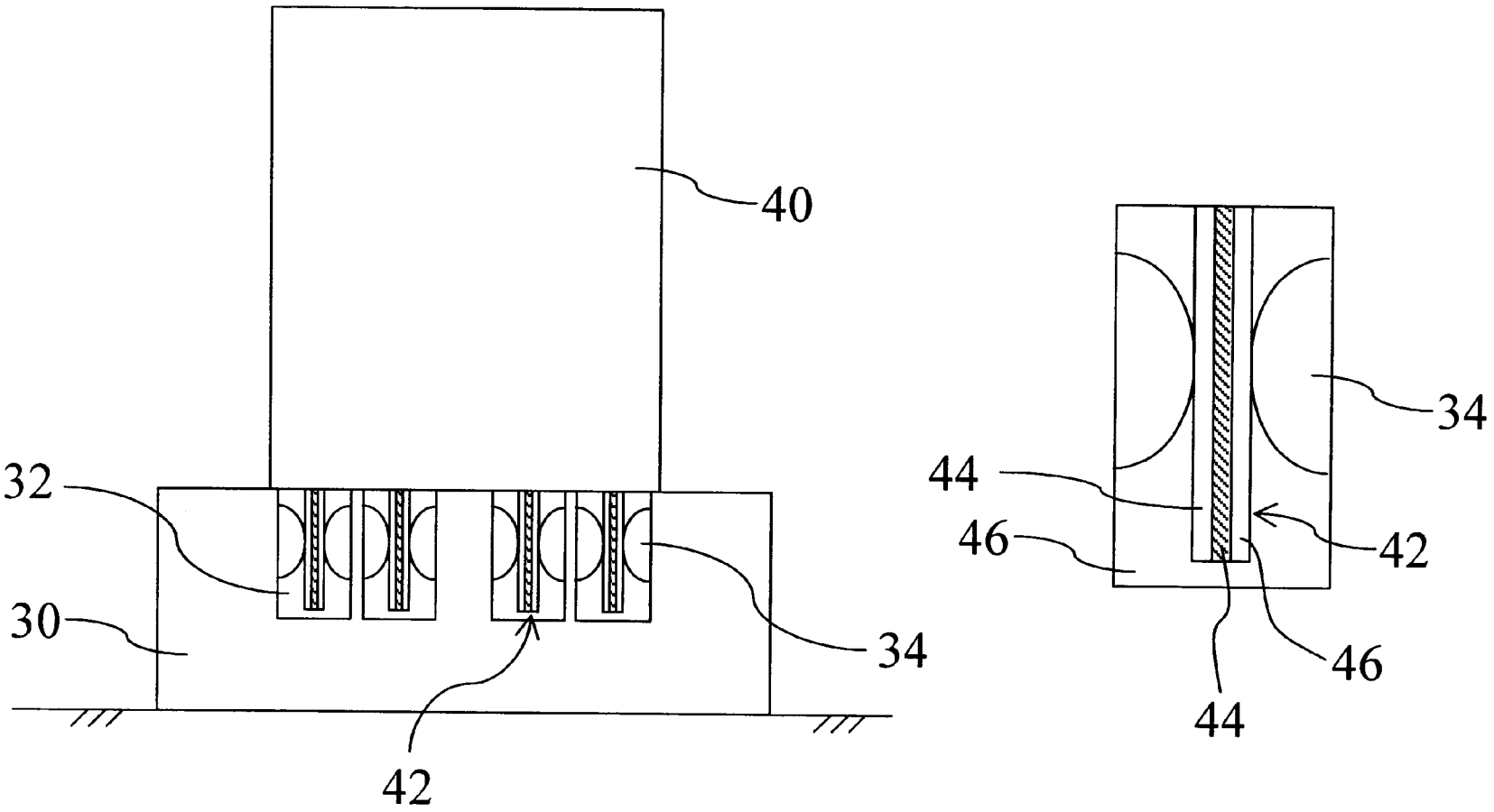
FIG. 3 is a schematic view of the base and the remote control receiver of the present invention after assembled.

The remote control receiver 40 of the present invention is used to receive the control signal emitted from the above remote controller module 10. As shown in FIGS. 2 and 3, the remote control receiver 40 is inserted in a base 30, which is installed at one side of a lamp tube and respectively connected to the lamp tube and the AC input terminal thereof. A plurality of recesses 32 is formed on the base 30, each recess having two mutually contacting resilient conductors 34 therein. A plurality of corresponding conductive pins 42 are installed at the bottom end of the remote control receiver 40 to be inserted into the recesses 32. Each of the conductive pins 42 is divided into two conductive parts 46 by an insulator 44. When the conductive pins 42 of the remote control receiver 40 are inserted into the recesses 32 of the base 30 to let the two resilient conductors 34 be separated, the two conductive parts 46 will respectively contact with the two resilient conductors 34. Therefore, the remote control receiver 40 is electrically connected to the lamp tube and the AC input terminal thereof, and can accept the control of the remote controller module momentarily so as to control the action of the lamp tube. When the remote control receiver 40 is not inserted into the base 30, the two resilient conductors 34 in each recess 32 will restore their original states and contact each other. At this time, the lamp tube is the same as a common lamp tube, and is directly controlled through the switch on the wall.

Figure 4:
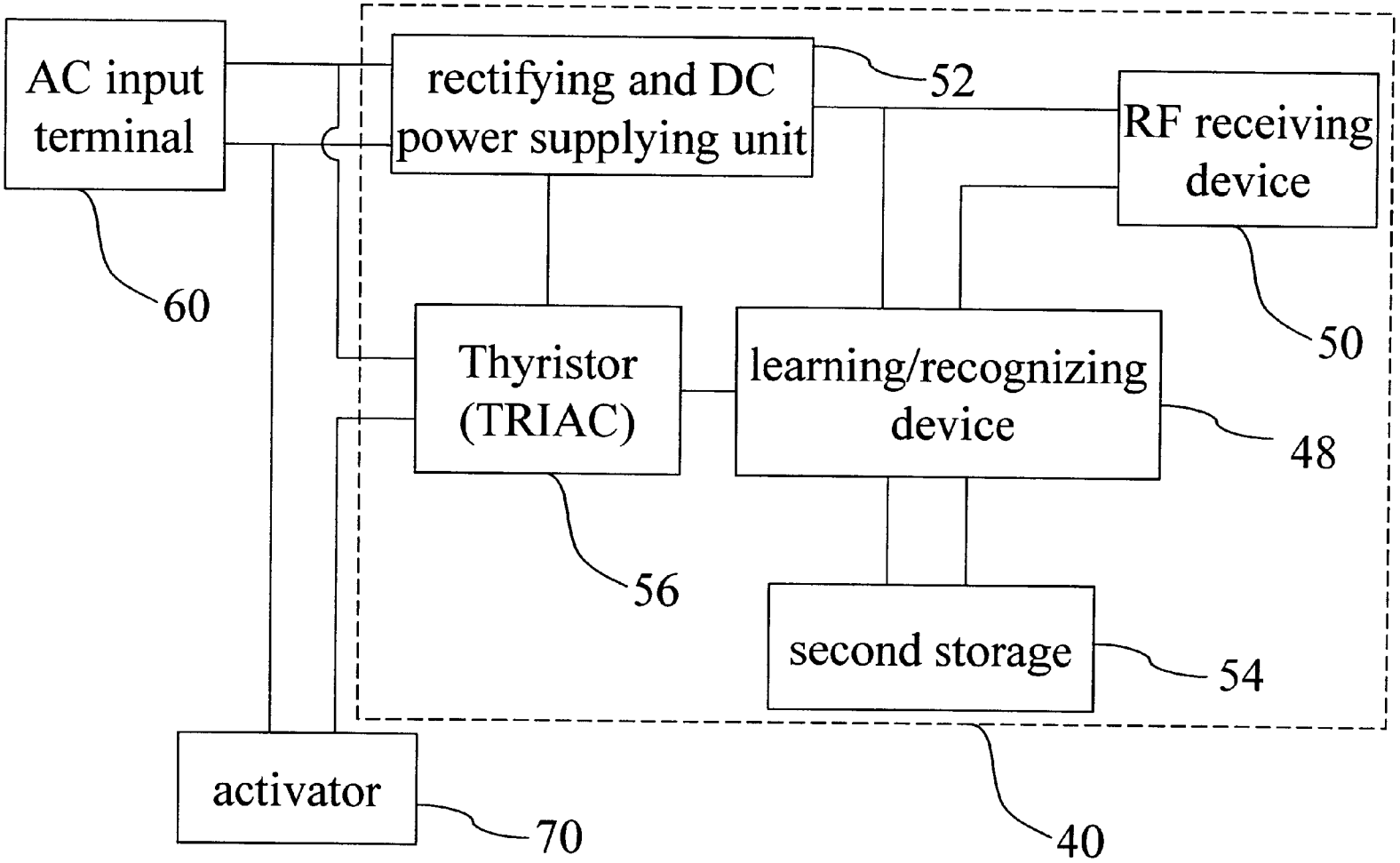
FIG. 4 is a block diagram of the remote control receiver of the present invention.

As shown in FIG. 4, the remote control receiver 40 comprises a learning/recognizing device 48, an RF receiving device 50, a rectifying and DC power supplying unit 52, and a second storage 54. The learning/recognizing device 48 is respectively connected to the RF receiving device 50, the rectifying and DC power supplying unit 52, and the second storage 54. The RF receiving device 50 is used to receive the remote control signal emitted from the remote controller module 10. The received remote control signal is then recognized and compared by the learning/recognizing device 48 to see whether the remote control code is correct. The RF receiving device 50 can also stores the received remote control code in the second storage 54. The second storage 54 stores the internal serial code of the remote control receiver 40 for comparing. After the received remote control code is unmistakably recognized by the learning/recognizing device 48, a confirmation signal is transferred to a thyristor (TRIAC) 56 connected therewith. The TRIAC 56 is an AC control switch with two ends thereof respectively connected to an AC input terminal 60 and an activator 70 of the lamp tube through the base 30.

If a remote control signal of the wireless remote control device is received by the remote control receiver 40, the TRIAC 56 of the remote control receiver 40 will open or close the AC power connected to the lamp tube to let the lamp tube be turned on or off. The rectifying and DC power supplying unit 52 is connected to the AC input terminal 60 and other components for transforming AC power into DC power to provide electricity for each component in the remote control receiver 40.

The above first storage 20 and second storage 54 are electrically erasable programmable read-only memories (EEPROMs).

Before the present invention is used, the serial codes and zone codes of the lamp tubes to be controlled must be keyed in via the keyboard control set. The codes are then emitted by the RF emitting device and then received by the RF receiving device in the remote control receiver. Next, the received serial codes are transferred to the learning/recognizing device to be learned and memorized there and then stored in the second storage. Thereby, the remote controller module can remotely control at least a remote control receiver that has learned and been set beforehand to control the action of at least a lamp tube.

Because independent remote control needs independent addressing way, the remote control receiver of the present invention in each lamp tube has a unique addressing way of serial code to be learned and copied by the remote controller module. Therefore, each remote controller module not only can control a lamp tube independently, but also can control several tens of lamp tubes through learning. The same key can be set for a plurality of lamp tubes by the remote controller module so that the lamp tubes can be controlled to be turned on or off simultaneously, resulting much convenience and flexibility in management.

To sum up, the present invention provides a remote control device of lamp tube to control the on or off states of lamp tubes through wireless remote control way. The remote control device of the present invention can be installed according to necessity, resulting in much convenience in use. Moreover, it is only necessary to unplug the remote control receiver from the base beside the lamp tube when the present invention is not in use. At this time, the lamp tube is the same as a common lamp tube, and can be directly controlled through the switch on the wall. Therefore, much flexibility and convenience in use can be achieved.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A remote control device of lamp tube for controlling the on or off state of at least a lamp tube through wireless remote control way, said remote control device of lamp tube comprising:

a remote controller module comprising a CPU, an RF emitting device, a keyboard control set, a display device, a first storage, and a power supply, said CPU being respectively connected to said RF emitting device, said keyboard control set, said display device, and said first storage, said CPU being used to receive keyed-in data from said keyboard control set and remote control serial codes, display them on said display device, and then store them in said first storage, said CPU also being used to transfer a remote control code to said RF emitting device to let said RF emitting device emit a remote control signal, a power supply being used to provide electricity for each of the above said components;

a base installed at one side of said lamp tube, a plurality of recesses being formed on said base, each of said recesses having two mutually contacting resilient conductors therein; and a remote control receiver inserted into said recesses of said base through a plurality of pins and electrically connected to an AC input terminal and said lamp tube, each of said pins being divided into two parts by an insulator, said remote control receiver comprising an RF receiving device, a learning/recognizing device, a rectifying and DC power supplying unit, and a second storage, said RF receiving device being used to receive said remote control signal emitted from said remote controller module, said learning/recognizing device being used for recognizing and comparing to verify said remote control code, a confirmative signal being transferred to a thyristor connected therewith, two ends of said thyristor being respectively connected to said AC input terminal and said lamp tube to open or close the AC power connected to said lamp tube according to said confirmative signal, said second storage being connected to said learning/recognizing device for storing the internal serial code and said received remote control code, said rectifying and DC power supplying unit being connected to said AC input terminal for transforming AC power into DC power to provide electricity for each of the above said components.

2. The remote control device of lamp tube as claimed in claim 1, wherein said CPU in said remote controller module is further connected to an RF receiving device for receiving and copying data transferred from another remote controller module.

3. The remote control device of lamp tube as claimed in claim 1, wherein said first storage and said second storage are electrically erasable programmable read-only memories.

* * * * *